US005597448A

United States Patent [19]

Reed et al.

[11] Patent Number: 5,597,448

[45] Date of Patent: Jan. 28, 1997

[54] METHOD FOR REDUCING PITCH DEPOSITION USING COPOLYMER OF N-VINYL ACETAMIDE

[75] Inventors: Peter E. Reed, Plainfield; Carol S. Greer, Lisle, both of Ill.

[73] Assignee: Nalco Chemical Company, Naperville, Ill.

[21] Appl. No.: 442,069

[22] Filed: May 16, 1995

Related U.S. Application Data

[63] Continuation-in-part of Ser. No. 141,296, Oct. 21, 1993, abandoned.

[51] Int. Cl.[6] ..... D21H 13/26; D21H 21/02

[52] U.S. Cl. ..... 162/166; 162/168.3; 162/199; 162/DIG. 4

[58] Field of Search ..... 162/166, 168.2, 162/168.3, 199, DIG. 4

[56] References Cited

U.S. PATENT DOCUMENTS 3,597,314 8/1971 Laube et al. ..... 162/168

*Primary Examiner*—Donald E. Czaja
*Assistant Examiner*—Dean T. Nguyen
*Attorney, Agent, or Firm*—Robert A. Miller; James J. Drake; Patricia A. Charlier

[57] ABSTRACT

Pitch in paper mills is controlled by treating paper mill systems with a water soluble polymer which contains a lower alkyl N-vinyl amide or a hydrolyzed lower alkyl N-vinyl amide.

2 Claims, No Drawings

METHOD FOR REDUCING PITCH DEPOSITION USING COPOLYMER OF N-VINYL ACETAMIDE

REFERENCE TO RELATED PATENT

The present application is a continuation-in-part of U.S. patent application Ser. No. 08/141,296 filed Oct. 21, 1993, now abandoned, by Peter E. Reed and Carol S. Greer entitled "Pitch Control in Paper Mill Systems", the disclosure of which is incorporated herein by reference.

BACKGROUND OF THE INVENTION

1. Field of the Invention

The invention relates to the use of certain N-vinyl amide polymers for use in controlling pitch in paper mill systems.

2. Introduction

The problem of pitch control in papermaking has previously been recognized. The pitch in the fibers of wood pulps is associated with naturally occurring lignin dispersing agents. Cooking and mechanical agitation which occur during the pulping by the sulfite process liberate pitch and these natural dispersing agents. However, as a result of the mechanical work on the fibers, the natural dispersing agents liberated along with the pitch are inadequate to keep the pitch from depositing on the equipment employed in beating, hydrating, refining, bleaching, and even on the wire used for forming the sheet. Because of the tendency of the pitch to agglomerate within the pulp suspension or deposit on the surfaces of the wire or other equipment, the pitch frequently causes the formation of spots or holes in the sheet formed. Additionally, the pitch may adhere to the wire or press rolls or dryer rolls and cause tearing of the sheet. The result of the pitch contamination is the production of sheets with numerous imperfections. Among other consequences of pitch deposition are the expense of cleaning the machinery frequently either with solvents or steam, and the loss of production during cleaning and replacing operations caused by breakdown of the sheet.

Cationic water soluble polymers are used commercially in the paper mills as pitch control agents. The present invention is predicated upon the discovery that certain water soluble lower alkyl N-vinyl amide polymers give colloidal pitch particle reduction in aqueous pulps.

The Invention

The invention consists of a process for controlling pitch deposition in pulp and papermaking systems. It comprises adding to the pulp a pitch controlling amount of a water soluble polymer which contains at least 5 mole percent of a lower alkyl N-vinyl amide or hydrolyzed lower alkyl N-vinyl amides. The lower alkyl N-vinyl amide polymers and the hydrolyzed lower alkyl N-vinyl amide polymers preferred for use in the practice of the invention have average molecular weights within the range of between 5,000–1,000,000. Preferably, the range is between 10,000 and 500,000.

The Lower Alkyl N-Vinyl Amide Polymers

The polymers used in the practice of the invention contain at least 5 mole percent of the lower alkyl N-vinyl amide. In most instances, the amount of the lower alkyl N-vinyl amide present in the polymer will be greater than 25 mole percent. The lower alkyl group of the N-vinyl amide usually contains from one to three carbon atoms. Illustrative of the lower alkyl N-vinyl amides that are present in the polymers used in the practice of the invention are N-vinyl formamide, N-vinyl acetamide and N-methyl(N-vinyl acetamide).

The other monomers present in the lower alkyl N-vinyl amide polymers may be selected from such monomeric groupings as N-vinyl amine, vinyl glycine, vinyl acetate, vinyl alcohol, acrylic acid, acrylamide and N-vinyl amides having alkyl groups containing between 12–22 carbon atoms. The amount of comonomer or termonomer present in the polymers of the invention often will be controlled by the method of preparation as well as effectiveness of a particular polymer in the control of pitch in a particular papermaking system.

The preparation of this polymer is frequently accomplished by the hydrolysis of a precursor lower alkyl N-vinyl amide polymer. Depending upon the degree of hydrolysis, the resulting polymer is either a polyvinyl amine (full or complete hydrolysis), or a polyvinyl amine copolymer of the starting lower alkyl N-vinyl amide which results from partial hydrolysis. Polymers containing vinyl alcohol groups are produced by the hydrolysis of lower alkyl N-vinyl amide/vinyl acetate copolymers. This hydrolysis often results in the production of vinyl amine groups as well as vinyl alcohol groups. Many of the lower alkyl N-vinyl amide copolymers are prepared using conventional polymerization techniques. Thus, the copolymers with acrylic acid or acrylamide are prepared in this fashion. These monomers typically are present in the copolymers in amounts ranging between 5 to 95 mole percent.

It is also possible to modify the polymers using organic modifying compounds such as alkylating agents to react with the vinyl amine containing polymers to produce secondary and tertiary amino groups. Typical is the use of chloroacetic acid to insert N-vinyl glycine groups into the molecule. Further, it is possible to insert fatty amide groups into the polymers by reacting N-vinyl amine groups with fatty acid chlorides which contain from 12–22 carbon atoms. Such a compounds is oleyl chloride.

To illustrate typical polymers used in the practice of the invention, Table 1 is presented below:

TABLE 1

| Polymer No. | Polymer Chemistry | | MW |
|---|---|---|---|
| A | Hydrolyzed p(vinylacetamide/vinylamine) Copolymer: 80–95% vinyl acetamide 20–50% vinyl amide | | 60,000–150,000 |
| B | A modified with chloroacetate: | Mole % | 60,000–150,000 |
| | N-vinyl acetamide | 80–95 | |
| | N-vinyl amine | 15-4} 20% of vinyl amine | |
| | N-vinyl glycine | 5-1} groups were modified with chloroacetate acid | |
| C | A modified with oleyl chloride | Mole % | 60,000–150,000 |
| | N-vinyl acetamide | 80–95 | |
| | N-vinyl amine | 17.5–2.5 | |
| | N-vinyl oleamide | 2.5 | |
| D | Substantially hydrolyzed 1:1 p(vinyl acetate/N-methyl-N-vinyl acetamide) | | 10,200 |

In Table I, the mole percents and the molecular weight ranges were furnished by the supplier of the N-vinyl amide or hydrolyzed N-vinyl amide.

DOSAGE

The Dosage and Utilization of the Polymers of the Invention

The polymers of the present invention can be added to the pulp at any stage of the papermaking system. They usually can be added as an aqueous solution. The effective amount of these polymers to be added depends on a number of variables, including the pH of the system, hardness, temperature, and the pitch content of the pulp. Generally, between 0.01–1 pound per ton of the composition is added based on the weight of the pulp slurry. Good results are often achieved at a dosage of between 0.05–0.5 pound per ton.

The polymers of the instant invention are effective in controlling pitch deposition in papermaking systems, such as Kraft, acid sulfite, and mechanical pulp papermaking systems. For example, pitch deposition occurring in the brown stock washer, screen room and decker systems of Kraft papermaking processes can be controlled. The term "papermaking" is meant to include all pulp processes. Generally, it is thought that the polymers can be utilized to prevent pitch deposition on all wetted surfaces from the pulp mill to the reel of the paper machine under a variety of pHs and conditions. More specifically, these polymers effectively decrease the deposition of metal soaps and other resinous pitch components. Metal surfaces and plastic and synthetic surfaces such as machine wires, felts, foils, uhle boxes and headbox components can all be protected by the invention.

SUMMARY OF THE INVENTION

Pitch in paper mills is controlled by treating paper mill systems with a water soluble polymer which contains a lower alkyl N-vinyl amide or a hydrolyzed lower alkyl N-vinyl amide.

DESCRIPTION OF THE INVENTION

The inventors have discovered a process for controlling pitch deposition in pulp and papermaking systems which comprises adding to the pulp a pitch controlling amount of a water-soluble polymer of N-vinyl acetamide and a second monomer selected from the group consisting of vinyl amine, vinyl glycine, N-vinyl amide having an alkyl group of from 12 to 22 carbon atoms, vinyl acetate and vinyl alcohol.

In this process, the water-soluble polymer may be partially hydrolyzed.

Alternatively, the water-soluble polymer is completely hydrolyzed.

A process for controlling pitch deposition in pulp and papermaking systems which comprises adding to the pulp a pitch-controlling amount of a water-soluble terpolymer of N-vinyl acetamide and two monomers selected from the group consisting of vinyl amine, vinyl glycine, an N-vinyl amide having an alkyl group of from 12 to 22 carbon atoms, vinyl acetate and vinyl alcohol.

In this process, the water-soluble terpolymer may be partially hydrolyzed.

Alternatively, the water-soluble terpolymer may be completely hydrolyzed.

A process for controlling pitch deposition in pulp and papermaking systems which comprises adding to the pulp a pitch-controlling amount of a water-soluble copolymer of N-vinyl-N-methyl acetamide and vinyl acetate in a 1:1 mole ratio.

In this process, the water-soluble copolymer may be partially hydrolyzed.

Alternatively, the water-soluble copolymer may be completely hydrolyzed.

EXAMPLES

The following examples are presented to describe preferred embodiments and utilities of the invention and are not meant to limit the invention unless otherwise stated in the claims appended hereto.

Pitch Deposition Test Procedure

It was found that pitch could be made to deposit from a 1.4% consistency hardwood Kraft fiber slurry containing approximately 1,650 ppm of a laboratory pitch and approximately 300 ppm calcium hardness (as $CaCo_3$) by adjusting the slurry to the desired test pH (4.5 or 6.0), adding the appropriate amount of inhibitor chemical and mixing the fiber slurry in an Osterizer blender for 4 minutes. The deposition was determined by the difference between the starting weight of a Teflon coupon suspended into the slurry during the test, and the dried weight of the coupon plus deposited pitch after completion of the test. The laboratory pitch was comprised of a mixture of primarily resin acids, fatty acids, and fatty esters.

Listed below are Tables 2 and 3 which show the polymers which were evaluated and demonstrated pitch control activity.

TABLE 2

INHIBITION OF PITCH DEPOSITION
SOFTWOOD PITCH @ pH 4.5

| Polymer[1] | Dosage Actives | Lb/Ton Basis | Pitch Weight | Deposit (MG) | % Inhibition of Pitch Deposition |
|---|---|---|---|---|---|
| Control-1 | | 0.00 | | 520 | |
| Control-2 | | 0.00 | | 489 | |
| Control-3 | | 0.00 | | 473 | |
| A | | 0.20 | | 340 | 31 |
| A | | 0.50 | | 314 | 37 |
| A | | 0.80 | | 201 | 59 |
| A | | 1.20 | | 164 | 67 |
| A | | 1.60 | | 114 | 77 |
| A | | 2.00 | | 51 | 90 |
| C | | 0.20 | | 471 | 5 |
| C | | 0.50 | | 239 | 52 |
| C | | 0.80 | | 189 | 62 |
| C | | 1.20 | | 89 | 82 |
| D | | 0.20 | | 470 | 5 |
| D | | 0.50 | | 215 | 57 |
| D | | 1.00 | | 138 | 72 |
| D | | 1.50 | | 62 | 87 |
| Control-4 | | 0.00 | | 497 | |
| B | | 0.50 | | 524 | –6 |
| B | | 1.20 | | 329 | 33 |
| B | | 2.00 | | 237 | 52 |
| B | | 3.00 | | 180 | 64 |
| B | | 4.00 | | 84 | 83 |
| Control-5 | | 0.00 | | 492 | |
| Control-6 | | 0.00 | | 504 | |

Average Control Pitch Deposit Weight = 495.8
1 Standard Deviation = 15.7 MG (3.2%)
1 = polymer as listed in Table 1

TABLE 3

INHIBITION OF PITCH DEPOSITION
SOFTWOOD PITCH @ pH 6.0

| Polymer[1] | Dosage Actives | Lb/Ton Basis | Pitch Weight | Deposit (MG) | % Inhibition of Pitch Deposition |
|---|---|---|---|---|---|
| Control-1 | | 0.00 | | 610 | |
| Control-2 | | 0.00 | 581 | | |
| A | | 0.20 | | 365 | 37 |
| A | | 0.50 | | 118 | 80 |
| A | | 0.80 | | 85 | 85 |
| A | | 1.20 | | 22 | 96 |
| C | | 0.20 | | 324 | 44 |
| C | | 0.50 | | 103 | 82 |
| C | | 0.80 | | 33 | 94 |

TABLE 3-continued

| INHIBITION OF PITCH DEPOSITION SOFTWOOD PITCH @ pH 6.0 | | | | | |
|---|---|---|---|---|---|
| Polymer[1] | Dosage Actives | Lb/Ton Basis | Pitch Weight | Deposit (MG) | % Inhibition of Pitch Deposition |
| D | | 0.20 | | 270 | 53 |
| D | | 0.30 | | 73 | 87 |
| D | | 0.50 | | 46 | 92 |
| Control-3 | | 0.00 | 581 | | |
| B | | 0.20 | | 529 | 18 |
| B | | 0.50 | | 366 | 37 |
| B | | 1.20 | | 116 | 80 |
| B | | 1.80 | | 77 | 87 |
| Control-4 | | 0.00 | 544 | | |

Average Control Pitch Deposit Weight = 579
1 Standard Deviation = 27.0 MG (4.7%)
1 = polymer as listed in Table 1

Changes can be made in the composition, operation and arrangement of the method of the present invention described herein without departing from the concept and scope of the invention as defined in the following claims:

We claim:

1. A process for controlling pitch deposition in pulp and papermaking systems which comprises adding to a pulp slurry of the papermaking systems of about 0.01 to 1 pound per ton, based on the weight of the pulp slurry, a pitch controlling amount of water-soluble polymer of N-vinyl acetamide and at least one monomer selected from the group consisting of vinyl amine, vinyl glycine, N-vinyl amide having an alkyl group of from 12 to 22 carbon atoms, vinyl acetate and vinyl alcohol wherein the polymer contains at least 5 mole percent of the N-vinyl acetamide and the pitch deposition in the pulp and papermaking systems is reduced.

2. A process for controlling pitch deposition in pulp and papermaking systems which comprises adding to a pulp slurry of the papermaking systems of about 0.01 to 1 pound per ton, based on the weight of the pulp slurry, a pitch-controlling amount of a water-soluble terpolymer of N-vinyl acetamide and two monomers selected from the group consisting of vinyl amine, vinyl glycine, an N-vinyl amide having an alkyl group of from 12 to 22 carbon atoms, vinyl acetate and vinyl alcohol wherein the terpolymer contains at least 5 mole percent of the N-vinyl acetamide and the pitch deposition in the pulp and papermaking systems is reduced.

* * * * *